US012358712B2

(12) United States Patent
Hellqvist et al.

(10) Patent No.: US 12,358,712 B2
(45) Date of Patent: Jul. 15, 2025

(54) PACKAGE DISPENSER FOR WIPES, PACKAGE BLANK AND A METHOD FOR THE PRODUCTION OF PACKAGE DISPENSER

(71) Applicant: Essity Hygiene and Health Aktiebolag, Gothenburg (SE)

(72) Inventors: Anders Hellqvist, Gothenburg (SE); Mikael Strandqvist, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 239 days.

(21) Appl. No.: 18/008,741

(22) PCT Filed: Jun. 26, 2020

(86) PCT No.: PCT/SE2020/050671
§ 371 (c)(1),
(2) Date: Dec. 7, 2022

(87) PCT Pub. No.: WO2021/262057
PCT Pub. Date: Dec. 30, 2021

(65) Prior Publication Data

US 2023/0312221 A1 Oct. 5, 2023

(51) Int. Cl.
*B65D 5/54* (2006.01)
*B65D 5/46* (2006.01)
*B65D 83/08* (2006.01)

(52) U.S. Cl.
CPC ..... *B65D 83/0847* (2013.01); *B65D 5/46096* (2013.01); *B65D 5/54* (2013.01)

(58) Field of Classification Search
CPC ..... B65D 83/0847
See application file for complete search history.

(56) References Cited

U.S. PATENT DOCUMENTS 2,874,870 A 2/1959 Collura
4,469,243 A 9/1984 Ito et al.
(Continued)

FOREIGN PATENT DOCUMENTS

CL 200601270 12/2006
CL 2019002547 A1 12/2019
(Continued)

OTHER PUBLICATIONS

International Search Report & Written Opinion for International Application No. PCT/SE2020/050671; International Filing Date: Jun. 26, 2020; Date of Mailing: Mar. 12, 2021; 19 pages.
(Continued)

*Primary Examiner* — Gene O Crawford
*Assistant Examiner* — Ayodeji T Ojofeitimi
(74) *Attorney, Agent, or Firm* — CANTOR COLBURN LLP

(57) ABSTRACT

A package dispenser for dispensing at least one stack of wipes, and having a bottom, top, two opposing side and two opposing end walls deliminating a storage space wherein, the top wall includes at least one dispensing opening; each of the at least one stack of wipes has a bottom surface, a top surface, two side and two end surfaces, each of the at least one stack of wipes resting on the bottom wall of the package dispenser, the top surface of the stack facing the top wall of the package dispenser;

each of the at least one stack of wipes in the package dispenser is a stack of interfolded wipes; and arranged to be dispensed from the top surface of the stack, the interfolded wipes in the stack being dispensed through a corresponding one of the at least one dispensing opening.

14 Claims, 4 Drawing Sheets

(56) References Cited

U.S. PATENT DOCUMENTS

| | | | | |
|---|---|---|---|---|
| 4,478,354 | A | 10/1984 | Notheis | |
| 5,687,875 | A | 11/1997 | Watts et al. | |
| 2002/0088820 | A1* | 7/2002 | Spivey | A47F 1/04 221/305 |
| 2003/0080180 | A1 | 5/2003 | Holley et al. | |
| 2003/0094461 | A1 | 5/2003 | Knol | |
| 2004/0124202 | A1 | 7/2004 | Mitchell et al. | |
| 2007/0119913 | A1* | 5/2007 | Holley | B65D 71/36 229/116.1 |
| 2009/0236408 | A1 | 9/2009 | Spivey et al. | |
| 2018/0339840 | A1 | 11/2018 | Doyle et al. | |

FOREIGN PATENT DOCUMENTS

| | | | |
|---|---|---|---|
| EP | 0135660 | | 4/1985 |
| EP | 0171036 | A2 | 2/1986 |
| FR | 2744428 | A1 | 8/1997 |
| JP | 50132423 | U | 4/1974 |

OTHER PUBLICATIONS

Chilean Application No. 202203767; Office Action dated Mar. 28, 2024 with English translation; 33 pages.
Chilean Application No. 202203767; Office Action with English translation dated Oct. 4, 2024; 29 pages.
European Application No. 20941873.0-1014; Extended European Search Report dated Mar. 25, 2024; 8 pages.

* cited by examiner

PACKAGE DISPENSER FOR WIPES, PACKAGE BLANK AND A METHOD FOR THE PRODUCTION OF PACKAGE DISPENSER

CROSS REFERENCE TO RELATED APPLICATION

This application is a National Stage application of PCT/SE2020/050671, filed Jun. 26, 2020, which is incorporated by reference in its entirety herein.

TECHNICAL FIELD

The disclosure relates to a package dispenser for containing and dispensing at least one stack of wipes, such as industrial wipes. The disclosure also relates to a blank from which the package can be made and a method for producing the package.

BACKGROUND

Disposable wipes are frequently used for heavy-duty wiping applications, in particular for object wiping and cleaning purposes in industrial environments. The wipes may be made from nonwoven materials and may include thermoplastic polymeric fibres, absorbent cellulosic fibres or combinations of thermoplastic polymeric fibres and cellulosic fibres. The wipes may be provided in the form of rolls of wiping material from which individual wipes may be torn off. Alternatively, individual wipes may be removed from a stack of folded wiping material. The wipes are commonly placed in a dispenser, which may be e.g., a roll stand or a dispensing box. For environments in which the need for wiping may arise in many different locations, it may be desirable for the dispenser to be easily moved by hand between different locations. Furthermore, it is desirable for the dispenser to be sturdy such that it can withstand repeated handling and such that it will rest in a stable and secure manner on a surface on which it is placed. Yet further requirements include the dispenser being easy to operate, allowing one-hand dispensing of one wipe at a time, and providing adequate storage and protection for the wipes until the last wipe has been dispensed. Moreover, the wipes are used in environments in which it is usually convenient if new wipes can be made immediately available as soon as a dispenser has been emptied of its contents, without having to load new unused wipes into the dispenser.

Thus, in view of the many different demands on dispensers for heavy-duty wipes, there is a need for further improvement of the currently available dispensers.

SUMMARY

The present disclosure is based on the insight that a practical and highly functional combined package and dispenser for wipes, in particular for heavy duty wipes, such as industrial wipes, may be achieved at least in part by the features of claim 1. A blank for making the package dispenser is defined in claim 13 and a method for making the package dispenser is defined in claim 14. Variations of the disclosure are set out in the dependent claims and in the following description.

The package dispenser as disclosed herein is a package dispenser for containing and dispensing at least one stack of wipes, the package dispenser having a bottom wall, a top wall, two opposing side walls extending in a height direction of the package dispenser and being parallel to a length direction of the package dispenser and two opposing end walls extending in the height direction of the package dispenser and being parallel to a width direction of the package dispenser, the bottom wall, the top wall, the side walls and the end walls together delimiting a storage space containing the at least one stack of wipes, wherein:

- the top wall comprises a handle;
- the top wall comprises provisions for creating at least one dispensing opening;
- each of the at least one stack of wipes has a bottom surface formed from a bottom wipe, a top surface formed from a top wipe, two side surfaces and two end surfaces, the side surfaces and the end surfaces extending between the bottom surface and the top surface, each of the at least one stack of wipes being placed in the storage space and resting with the bottom surface on the bottom wall of the package dispenser, and with the top surface of the stack facing the top wall of the package dispenser;
- each of the at least one stack of wipes in the package dispenser is a stack of interfolded wipes; and
- each of the at least one stack of wipes is arranged to be dispensed from the top surface of the stack, the interfolded wipes in the stack being dispensed through a corresponding one of the at least one dispensing opening.

The package dispenser as disclosed herein serves both as a package for storing the one or more stacks of wipes up until they are to be used and as a dispenser for dispensing individual wipes from the stacks of interfolded wipes contained in the package dispenser. The package dispenser is easily converted by hand from the initial closed configuration in which the package dispenser offers protection for the wipes during transport and storage prior to use into the dispensing configuration in which at least one dispensing opening has been formed in the package dispenser. The at least one dispensing opening may be formed manually without using any tool, such as a knife, scissors, etc.

By the provision of a handle, the package dispenser can be lifted and moved from one location to another, as needed.

The at least one dispensing opening may comprise a dispensing opening portion which extends into a side wall of the package dispenser, the side wall of the package dispenser comprising provisions for creating the dispensing opening portion in the side wall of the package dispenser. A dispensing opening which extends from the top wall of the package dispenser into the adjacent side wall makes the wipes in the package dispenser more readily accessible for grabbing and removing from the package dispenser. When the height of a stack of wipes has been reduced after a number of wipes have been removed from the stack, the current top wipe is still easy to reach and grab as it is exposed in the dispensing opening portion in the side wall.

The provisions for creating the at least one dispensing opening may comprise or consist of one or more material weakenings which are arranged in the package dispenser.

The material weakenings may be any suitable weakenings as known in the art such as scorings, perforations, cut-outs, etc. The material weakenings may be arranged to allow a portion of the package dispenser wall to be completely torn out or punched away, or to be folded out to create the one or more dispensing openings.

As set out herein, two stacks of interfolded wipes may be arranged in the storage space of the package dispenser. The stacks may be arranged to be dispensed through a single common dispensing opening arranged in the top wall and optionally also in one or both of the side walls adjoining the top wall. Alternatively, separate dispensing openings for each of the stacks may be arranged in the top wall and optionally also in one or both of the corresponding adjoining side walls.

As set out herein, any useful number of stacks of interfolded wipes may be arranged in the storage space of the package dispenser, such as one, two, three, four, five, six, for example. The stacks may be arranged to be dispensed through a dispensing opening which is shared with one or more other stacks or may be arranged to be dispensed through a dispensing opening being dedicated to a particular stack.

The top wall may comprise two overlapping top wall portions:

an inner top wall portion being part of an inner top panel having a length in the length direction of the package dispenser which is greater than a length in the length direction between the side walls of the package dispenser, the inner top panel comprising the inner top wall portion, a first top panel end wall portion and a second top panel end wall portion, each of the first top panel end wall portion and the second top panel end wall portion being folded in the height direction toward the bottom wall and forming part of a respective one of the side walls of the package dispenser; and a outer top wall portion being formed from an outer top panel having a length in the length direction which is equal to or shorter than the length in the length direction between the side walls of the package dispenser, the outer top wall portion overlying and being supported by the inner top panel, the inner top wall portion of the inner top panel and the outer top wall portion together constituting the top wall of the package dispenser.

The handle of the package dispenser as disclosed herein may be a two-part handle. A first handle part may be formed from an inner top panel and a second handle part may be formed from an outer top panel.

In a package dispenser as disclosed herein, each of the side walls may be formed from a side panel, and each of the end walls may be formed from overlapping panel end parts which are panel end parts of the two side panels, an inner top panel and panel end parts of a bottom panel forming the bottom wall.

When forming the package dispenser, the side panel end parts are folded in first, and thereafter the top panel end parts and the bottom panel end parts are folded in over the side panel end parts. The size of the panel end parts may be such that the side panel end parts meet along an end wall centre line extending in the height direction of the package dispenser and the bottom panel end parts meet along an end wall centre line extending in the width direction of the package dispenser. In this manner, the end wall will be made up of two layers of panel material.

The package dispenser as disclosed herein may be made from a relatively rigid and durable material which allows the package dispenser to be moved around and handled without special care. As set out herein, the package dispenser may be a cardboard package dispenser, such as a corrugated fibreboard package dispenser. As used herein, the term "cardboard package dispenser" refers to a package in which the walls of the package dispenser are made of cardboard material. Also the handle may be made from cardboard material e.g., by the handle being created from a portion of the top wall material, as set out herein. Alternatively, the handle may be separately produced and attached to the package dispenser. A separately produced handle may be made from plastic or cardboard and may have any suitable form such as a preshaped rigid grip, a flexible loop, etc.

The wipes making up the one or more stacks of interfolded wipes in the package dispenser as disclosed herein may be referred to as being reversed interfolded wipes. A stack of wipes which are reversed interfolded is configured to be dispensed from the top of the stack toward the bottom of the stack.

The stacks of interfolded wipes as disclosed herein have a generally rectangular shape and are sized to fit in the rectangular storage space defined by the walls of the package dispenser.

That the wipes are interfolded means that they are interleaved, i.e., folded into one-another, so that they form a chain of wipes being interconnected by folded portions. In this manner, when removing one wipe from the stack of wipes and pulling the wipe completely through the dispensing opening in the package dispenser, the pulled-out wipe will automatically bring a portion of the next wipe in the stack out through the opening thereby making it readily available for gripping and removing from the package dispenser. The connection between the wipes in the stacks of interfolded wipes relies on friction between contacting surfaces of the individual wipes. No other connection means such as non-broken tab portions between the individual wipes or adhesive are therefore necessary.

The interfolded wipes as disclosed herein may have a length of from 20 to 100 cm and a width of from 20 to 40 cm. The number of panels in each wipe may be from 3 to 10.

The interfolded wipes as disclosed herein may be relatively large wipes with a surface area in the range of from 0.10 $m^2$ to 0.25 $m^2$ and may each have dimensions in a flat, unfolded state of e.g., 42 cm×35.5 cm or 63 cm×35.5 cm.

The basis weight of the interfolded wipes as disclosed herein may be from 40 $g/m^2$ to 150 $g/m^2$.

The thickness of the interfolded wipes as disclosed herein may be from 0.4 mm to 2 mm per ply.

Thickness of the wipes was measured according to EDANA's and INDA's Nonwoven Standard Procedure: NWSP 120.6.R0 (15).

The thickness was measured according to the procedure for regular nonwovens by measuring the distance between a reference plate on which the nonwoven rests and a parallel presser-foot (or plate) that exerts a specified pressure on the area under test. An apparatus used for conducting the measurements should be configured as follows. The upper plate or presser-foot shall be capable of moving vertically.

a) The upper plate shall have an area of approximately 2500 $mm^2$.

b) The reference plate shall have a plane surface of diameter at least 50 mm greater than that of the presser-foot.

c) Measuring device, having a scale with 0.01 mm graduations.

Test specimens should be taken from areas of the sample that are free of folds, wrinkles and any distortions that would make these specimens abnormal from the rest of the test material. The test specimens should be larger than the area of the presser-foot.

The samples should be conditioned in the standard atmosphere for testing nonwovens as directed in ISO 139.

Test Procedure:

1. Using the apparatus specified above, adjust the load on the presser-foot to give a uniform pressure of 0.5 kPa. Set the measuring device to zero.

2. Raise the presser-foot and position the test specimen centrally with respect to the presser-foot, and without tension, on the reference plate.
3. Lower the presser-foot carefully until contact is made with the test specimen, and leave in contact for 10 s.
4. Adjust the measuring device and note the reading, in mm.
5. Repeat the procedure with 9 more test specimens.

In a package dispenser as disclosed herein, each of the at least one stack of interfolded wipes may contain from 50 to 130 interfolded wipes, such as from 60 to 120 interfolded wipes, from 70 to 110 interfolded wipes or from 90 to 105 interfolded wipes, for example. Larger wipes will generally have a smaller number of interfolded wipes in each stack, such as 50 to 80 interfolded wipes for example, while smaller wipes may have a larger number of interfolded wipes in each stack, such as 80 to 130 interfolded wipes, for example.

The wipe material may be any suitable wiping material. In particular, the interfolded wipes may be made from nonwoven material, such as a hydroentangled material comprising cellulosic fibres.

The wipe material may be made from up to 100% staple fibres, such as regenerated cellulose fibres, thermoplastic fibres, etc. The wipe material may comprise cellulose pulp in combination with staple fibres.

The term "cellulosic staple fibres" as used herein refers to man-made and natural cellulosic fibres. Examples of man-made cellulosic fibres, also called regenerated cellulosic fibres, are lyocell and viscose. Examples of natural cellulosic fibres are seed hair fibres, e.g. cotton, kapok, and milkweed; leaf fibres, e.g. sisal, abaca, pineapple, and New Zealand hemp; or bast fibres e. g. flax, hemp, jute and kenaf.

If the cellulosic staple fibres are man-made fibres, they may be treated with spin finish and crimped. Spin finish and crimp is normally added to ease the handling of the fibres in a dry process, e.g. a card, and/or to give desired properties, e.g. hydrophilicity, to a material consisting only of these fibres.

Cutting of a fibre bundle to staple fibres is normally made to produce a single cut length, which may be altered by varying the distance between the knives of a cutting tool such as a cutting wheel. Thereby the fibre length may be set according to requirements of the continued processing of the fibres into a wiping material.

The term "cellulosic staple fibres" as used herein refers to fibres that have been cut from fibre bundles to a length being within a desired length range, as well as fibres having a natural length being within the desired length range, e.g. some of the natural cellulosic fibres mentioned above, also called staple-length fibres. The desired length may be e.g., in the range of 2-25 mm, such as within the range of 2-20 mm, 5-15 mm or 6-12 mm, for example.

The term "cellulose pulp fibres" as used herein refers to pulp fibres from chemical pulp, e.g. kraft, sulphate or sulphite, mechanical pulp, thermo-mechanical pulp, chemo-mechanical pulp and/or chemo-thermo-mechanical pulp, abbreviated as CTMP. Pulps derived from both deciduous (hardwood) and coniferous (softwood) may be used. Fibres may also come from non-wood plants e.g., cereal straws, bamboo, jute or sisal. The fibres or a portion of the fibres may be recycled fibres, which may belong to any or all of the above categories.

Furthermore, the wipes may include recycled textile fibres.

Additives such as softeners, dry-strength agents or wet-strength agents may be added in order to facilitate manufacturing of the wipe material and to adjust the properties thereof.

The package dispenser as disclosed herein may be formed from a package blank, wherein the package blank comprises:

a bottom panel comprising a bottom wall portion, the bottom wall portion having a first and a second side edge extending in the length direction and a first and a second end edge extending in the width direction, the bottom wall portion having a length in the length direction and a width in the width direction, a first bottom panel end wall portion extending in the length direction from the first end edge of the bottom wall portion and a second bottom panel end wall portion extending from the second end edge of the bottom wall portion;

an inner top panel comprising an inner top wall portion, the inner top wall portion having a first end edge and a second end edge extending in the width direction and a first side edge and a second side edge extending between the first end edge and the second end edge, the inner top wall portion having a length equal to the length of the bottom wall portion of the bottom panel and a width equal to or less than the width of the bottom wall portion of the bottom panel, and having a first top panel end wall portion extending in the length direction from the first end edge of the inner top wall portion and a second top panel end wall portion extending from the second end edge of the inner top wall portion;

an outer top panel, the outer top panel having a first end edge and a second end edge extending in the width direction and a first side edge and a second side edge extending between the first end edge and a second end edge, a length of the outer top panel being equal to or less than the length of the bottom wall portion of the bottom panel and being equal to or less than the length of the inner top wall portion of the inner top panel;

a first side panel, the first side panel comprising a first side wall portion, the first side wall portion of the first side panel having a first and a second side edge extending in the length direction and a first and a second end edge extending between the first and the second side edges of the first side wall portion, a first side panel end wall portion extending in the length direction from the first end edge of the first side wall portion of the first side panel and a second side panel end wall portion extending from the second end edge of the first side wall portion of the first side panel, the first side panel being contiguous with the inner top panel along the first side edge of the inner top wall portion;

a second side panel, the second side panel comprising a second side wall portion, the second side wall portion of the second side panel having a first and a second side edge extending in the length direction and a first and a second end edge extending between the first and the second side edges of the second side wall portion, a first side panel end wall portion extending in the length direction from the first end edge of the second side wall portion of the second side panel and a second side panel end wall portion extending from the second end edge of the second side wall portion of the second side panel, the second side panel being contiguous with the outer top panel along the first side edge of the outer top panel; and wherein a handle is arranged in the inner top panel and/or in the outer top panel; and one or both of the inner top panel and the outer top panel comprises provisions for creating at least one dispensing opening.

The outer top panel may have inclined end edges, which means that the end edges need not be parallel to the end edges of the inner top wall portion of the inner top panel.

In order to facilitate and promote correct folding of the package blank, fold-lines may be arranged between panels and panel portions.

The package dispenser as disclosed herein may be formed by a method of forming a package dispenser containing at least one stack of interfolded wipes, the method comprising the steps of:

providing a package blank as disclosed herein;

providing at least one stack of interfolded wipes, the stack having a bottom surface being formed from a bottom wipe, a top surface being formed from a top wipe, two side surfaces and two end surfaces, the side surfaces and the end surfaces extending between the bottom surface and the top surface;

placing at the at least one stack of interfolded wipes with each of the at least one stack of wipes resting with the bottom surface on the bottom wall portion of the bottom panel of the package blank;

raising the first side panel and the second side panel in the height direction by folding the package blank along the first and second side edges of the bottom wall portion of the bottom panel;

folding in the first and second side panel end wall portions of the first and second side panels in the width direction by folding the package blank along the first and second end edges of the side wall portion of each of the first and second side panels;

raising the first bottom panel end wall portion and the second bottom panel end wall portion in the height direction by folding the package blank along the first and second end edges of the bottom wall portion of the bottom panel;

folding in the inner top panel in the width direction by folding the package blank along the second side edge of the side wall portion of the first side panel;

folding in the outer top panel in the width direction in over the inner top panel by folding the package blank along the second side edge of the side wall portion of the second side panel; and folding down the first end wall portion and the second end wall portion of the inner top panel in the height direction by folding the package blank along the first and second end edges of the inner top wall portion.

Adhesive may be applied between overlapping portions of the package blank during folding of the package blank to keep the resulting package dispenser in the folded configuration with the one or more stacks of interfolded wipes contained in the package. Alternatively or in addition to using adhesive for attaching the package parts to each other, adhesive tape, staples, etc. may be used, as known in the art.

BRIEF DESCRIPTION OF THE DRAWINGS

The package dispenser, the package blank and the method as disclosed herein will be further explained hereinafter with reference to the appended drawings in which.

DETAILED DESCRIPTION

Different aspects of the present disclosure will be described more fully hereinafter with reference to the drawings. The package dispenser as disclosed herein can be realized in many different forms within the scope of the appended claims and should not be construed as being limited to the aspects set forth herein.

Figure 1:
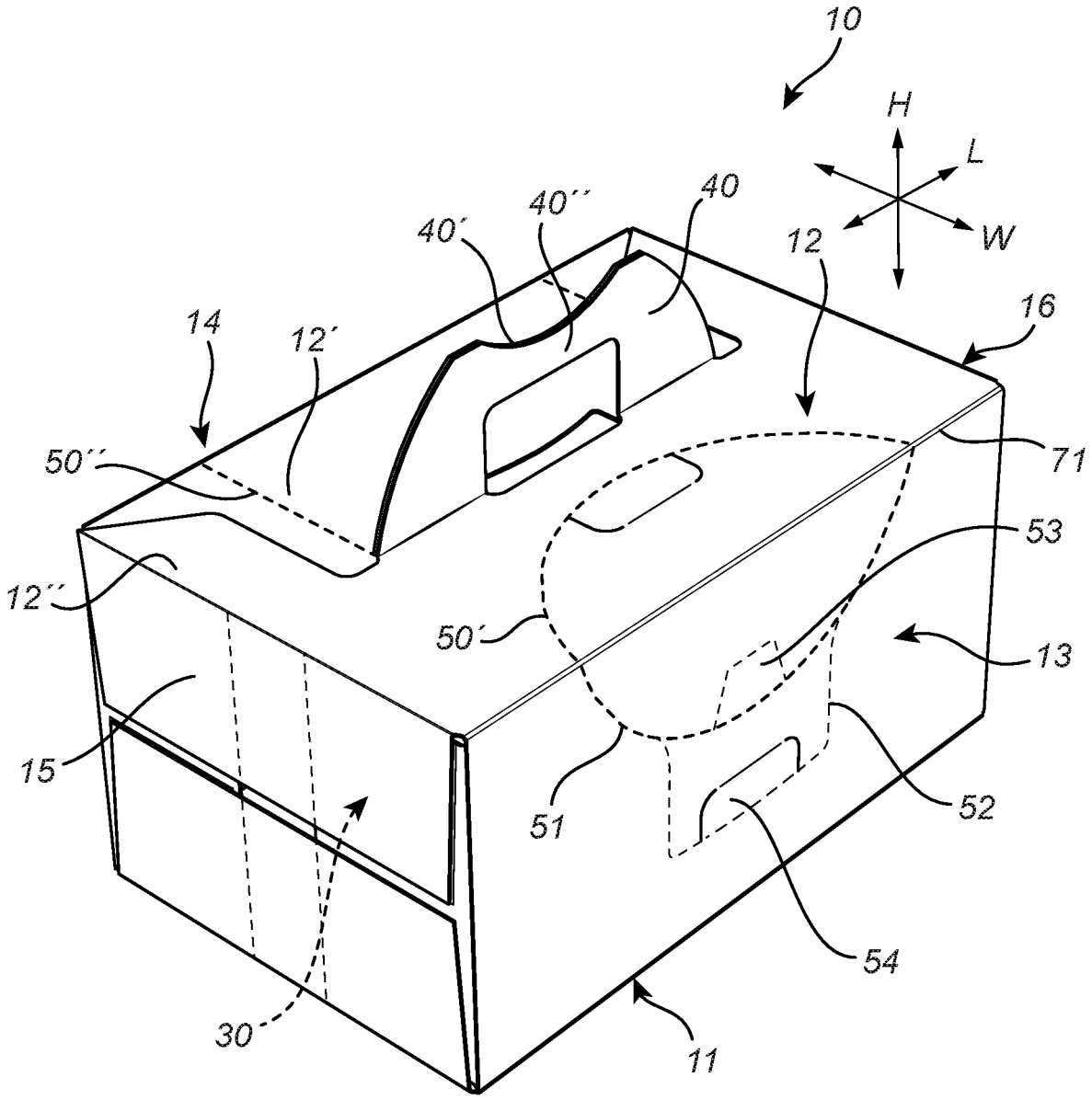
FIG. 1 shows a package dispenser as disclosed herein before a first opening.

FIG. 1 shows a package dispenser 10 for containing and dispensing two stacks 20 of wipes 21. As set out herein, the number of stacks in the package dispenser may be one, two, or even a higher number such as three, four, for example.

The package dispenser 10 as shown in FIG. 1 has a bottom wall 11, a top wall 12, two opposing side walls 13, 14 extending in a height direction H of the package dispenser 10 and parallel to a length direction L of the package dispenser 10, and two opposing end walls 15, 16 extending in the height direction H of the package dispenser 10 and parallel to a width direction W of the package dispenser 10. The bottom wall 11, the top wall 12, the side walls 13, 14 and the end walls 15, 16 jointly delimit a storage space 30 which contains the two stacks 20 of interfolded wipes 21. The package dispenser 10 may be made from any suitable material having an appropriate combination of shape stability and flexibility. Particularly suitable materials may be cardboard materials, such as corrugated fibreboard. Such materials are made from readily available renewable raw materials, are relatively low-cost, and are well suited for post-use treatment in existing waste recovery systems.

Figure 3:
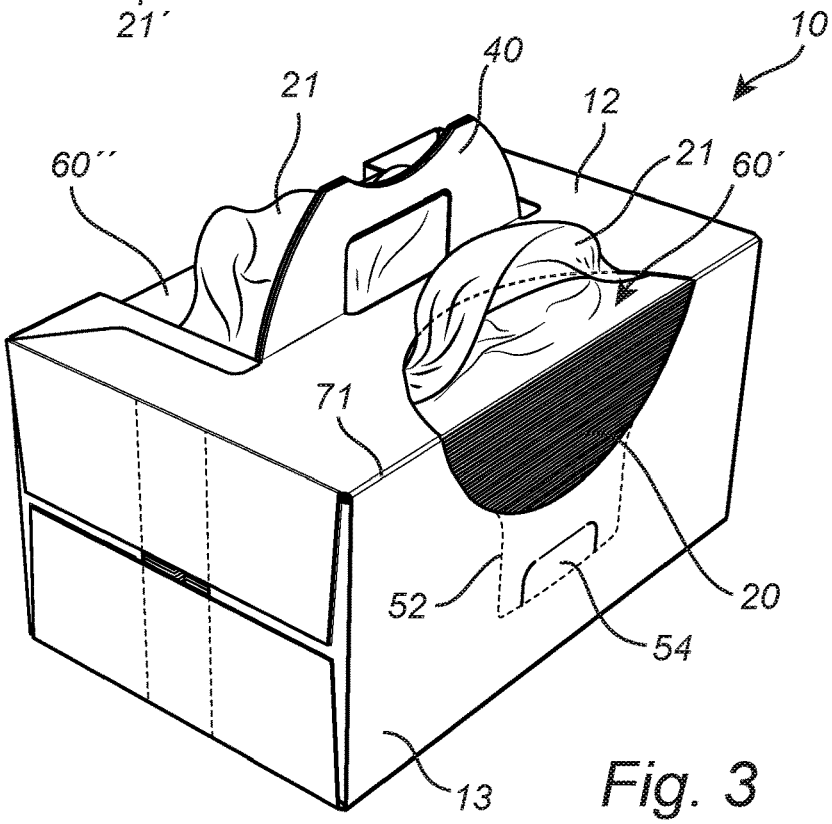
FIG. 3 shows the package dispenser in FIG. 1 after opening.

A handle 40 is shown to be arranged on the top wall 12. In the package dispenser 10 shown in FIGS. 1 and 3, the top wall 12 is formed by an inner top wall portion 12' and an outer top wall portion 12", the outer top wall portion 12" overlying and being supported by the inner top wall portion 12'. The handle 40 is a two-part handle, with a first handle part 40' being formed from the inner top wall portion 12' and a second handle part 40" being formed from the outer top wall portion 12". The first handle part 40' has been formed from the material in the inner top wall portion 12' by partial separation of a handle portion of the inner top wall portion 12' along separation lines provided in the inner top wall portion material. The separation lines may be provided as weakenings of the top panel material e.g., by means of scoring, perforating, cutting, etc. After separation of the handle portion of the inner top wall portion 12', the first handle part 40' can be folded up into the configuration shown in FIG. 1. For the second handle part 40" as shown in FIGS. 1 and 3, no separation step is needed, as the second handle part is formed by a handle-shaped portion of an edge of the outer top wall portion 12" which can simply be folded up into the configuration shown in FIG. 1 to create the two part handle 40.

The top wall 12 and the side walls 13, 14 further comprise provisions 50', 50" for creating a dispensing opening 60', 60" on each side of the handle 40. The provisions 50', 50" are constituted by intermittent cuts and perforations made in the material in the top wall and in the side walls 13, 14 along a contour of each of the dispensing openings 60', 60". In the package dispenser 10 in FIG. 1, the provisions 50' which are arranged in the outer top wall portion 12" and in the side wall 13 which is visible in FIG. 1 are made up of two major parts. An upper part 51 of the provisions 50' has a generally oval or circular outline which wraps over an upper edge 71 of the side wall 13 and a lower part 52 of the provisions 50' has a generally rectangular outline. Each of the upper and lower parts 51, 52 of the provisions 50' comprises a grip portion 53, 54 that can be used to create a first small grip opening at an edge of the corresponding upper or lower part 51, 52 of the provisions 50' by pushing in or folding out the grip portion 53, 54. Thereafter, the grip opening can be used to facilitate removal of the full upper or lower part 51, 52 of the provisions 50" for creating a dispensing opening. Generally, when first opening the package dispenser 10, only the upper part 51 of the provisions 50' for creating a dispensing opening are employed, such that the dispensing opening 60' initially has the shape and size of the material which is removed inside the upper part 51 of the provisions 50'. The material inside the lower part 52 of the provisions 50' may then remain as a support and protection for the lower part of the stack 20 of interfolded wipes 21. As wipes 21 are successively removed from the package dispenser 10 through the dispensing opening 60', the height of the stack 20 of interfolded wipes 21 will gradually decrease until it reaches down to where the lower part 52 of the provisions 50' are located. In order to facilitate dispensing of the remaining wipes 21, the lower part 52 of the provisions 50' may then be employed to increase the size of the dispensing opening 60' by extending it further down along the side wall 13.

It is to be understood that a two-part construction of the provisions for creating a dispensing opening is not a requirement of the package dispenser as disclosed herein. Other constructions, such as a single part construction or a construction allowing more than two parts to be separately removed are also contemplated herein. Multi-part constructions of the provisions for creating a dispensing opening may be used to create dispensing openings which may be varied with regard to size as well as shape.

It is also to be understood that the shape of the dispensing opening 60', 60" may differ from the shapes shown in the Figures. Notably, in the package dispenser 10 which is shown in FIGS. 1 and 3, the parts of the dispensing openings 60', 60" which are arranged in the top wall 12 have different outlines. In the dispensing opening 60' which is most clearly visible in FIG. 3 i.e., the dispensing opening which is arranged in the outer top wall portion 12" and in the side wall 13 which is facing the viewer of FIG. 3, the dispensing opening 60' has an arch-shaped outline in the outer top wall portion 12". In the dispensing opening 60" which is arranged in the inner top wall portion 12' and in the side wall 14 which is facing away from the viewer of FIG. 3, the dispensing opening 60" has a generally rectangular outline in the inner top wall portion 12'.

When two or more dispensing openings are arranged in a package dispenser as disclosed herein, the dispensing openings may have the same or different sizes as well as the same or different outlines. A package dispenser containing two or more stacks of interfolded wipes may have the same type and size of wipes in all stacks. Alternatively one or more stack of wipes in the package dispenser may be constituted by wipes having a different constitution and/or a size different from another stack of wipes in the package dispenser. In such case, the size and outline of the dispensing openings may be adapted to differences in the wipes. By way of example, a more flexible wipe may be better dispensed from a smaller dispensing opening relative to a stiffer wipe. The size and shape of the dispensing openings may also be used to signal differences in the properties of the wipes to be dispensed through the openings.

Figure 2:
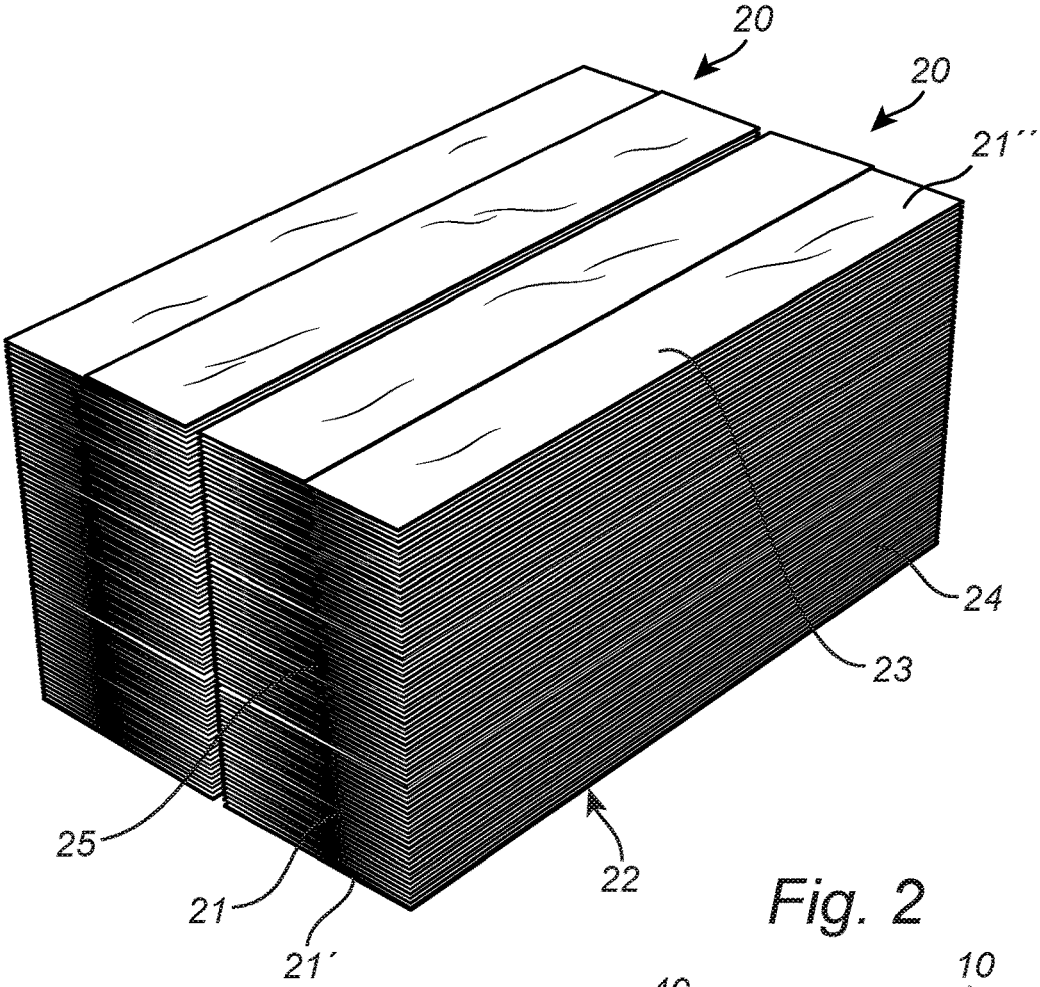
FIG. 2 shows two stacks of interfolded wipes suitable for placing in the package dispenser in FIG. 1.

FIG. 2 shows two stacks 20 of interfolded wipes 21, which stacks 20 may fit in the package dispenser 10 as shown in FIGS. 1 and 3.

Each stack 20 has a rectangular shape with a bottom surface 22 formed from a bottom wipe 21', a top surface 23 formed from a top wipe 21", two side surfaces 24 and two end surfaces 25, the side surfaces 24 and the end surfaces 25 extending between the bottom surface 22 and the top surface 23. The stacks 20 of wipes 21 are placed in the storage space 30 of the package dispenser 10 with the bottom surface 22 of the stack 20 resting on the bottom wall 11 of the package dispenser 10, and with the top surface 23 of the stack 20 facing the top wall 12 of the package dispenser 10.

Each stack 20 of wipes 21 is a stack 20 of interfolded wipes 21, the wipes 21 being arranged to be dispensed from the top surface 23 of the stack 20 through a dispensing opening 60', 60" in the package dispenser 10.

Figure 4:
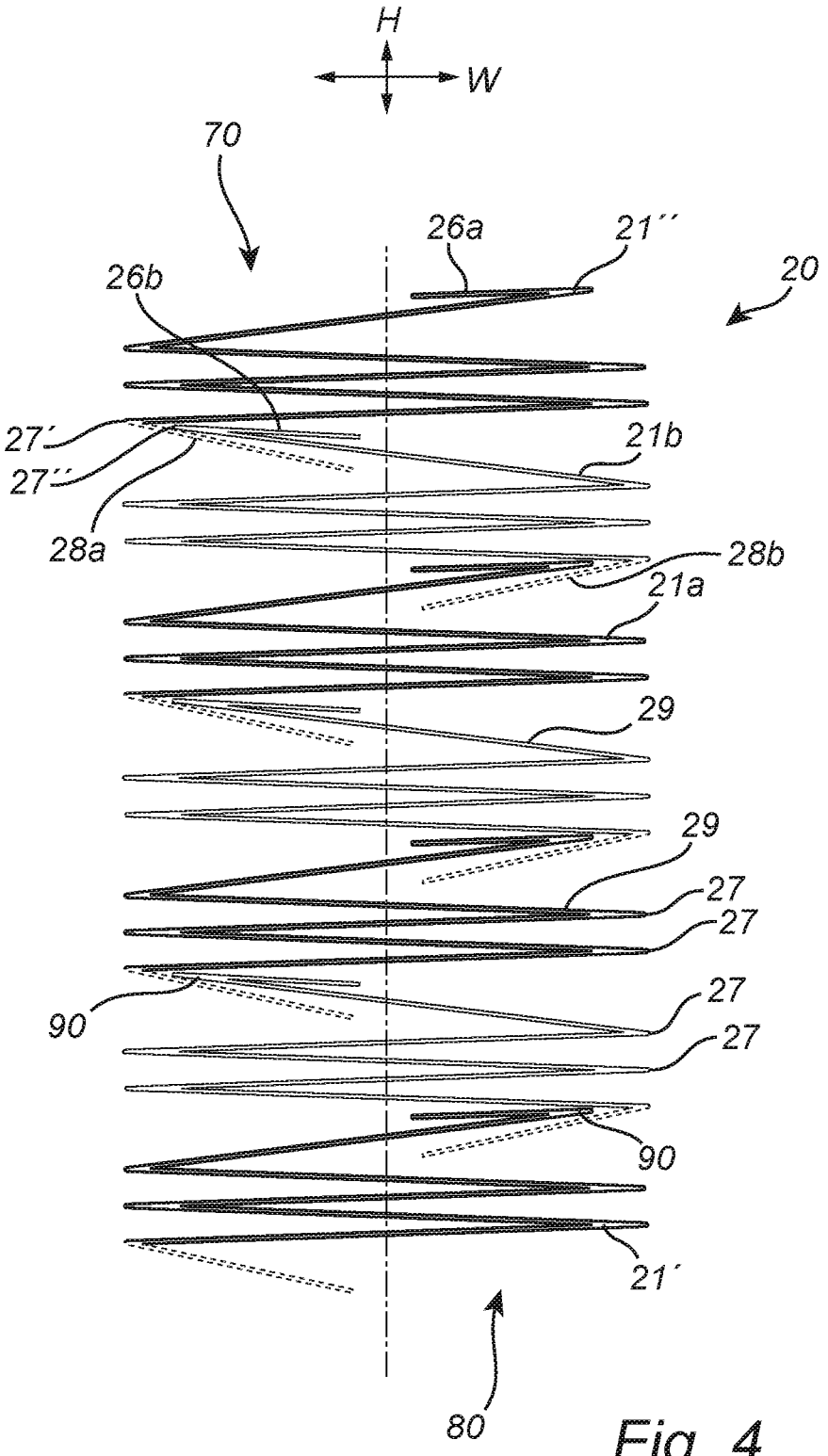
FIG. 4 shows a schematic cross-section through one stack of interfolded wipes as shown in FIG. 2.

FIG. 4 shows schematically a cross section through a stack 20 of interfolded wipes 21*a*, 21*b* as shown in FIG. 2. The interfolding arrangement in FIG. 4 is an example of how the interfolded wipes 21*a*, 21*b* may be arranged to allow the interfolded wipes 21*a*, 21*b* to be dispensed from the top 70 of the stack 20 to the bottom 80 of the stack 20. Each wipe 21*a*, 21*b* is folded multiple times along longitudinally extending fold lines in order to decrease the extension of the wipes 21*a*, 21*b*. The folds 27 will be arranged at the longitudinally extending side surfaces 24 of the stack 20 as shown in FIG. 2. A top panel 26*a*, 26*b* of each wipe 21*a*, 21*b* and a bottom panel 28*a*, 28*b* of each wipe 12*a*, 2*b* has a smaller extension in the width direction W of the stack 20 than the intervening panels 29 which extend over the full width of the stack 20 between the folds. As is seen in FIG. 4, the top panel 26*a* on the top wipe 21" forms a flap which may serve as gripping member when removing the top wipe 21" from the stack 20. The wipes 21*a*, 21*b* are arranged with the top fold 27" and the bottom fold 27' located on opposite sides of the stack 20 and such that the fold direction alternates between each wipe 21*a*, 21*b*. Except for the top wipe 21" and the bottom wipe 21', the wipes 21*a*, 21*b* are arranged with the top fold 27" of a following wipe 21 inserted into the bottom fold 27' of a preceding wipe to create links 90 between the individual wipes 21*a*, 21*b* of the chain of wipes 21*a*, 21*b* in the stack 20. As for the bottom and top folds 27', 27", the position of the links 90 shifts between each wipe 21*a*, 21*b* such that it alternates between the side surfaces 24 of the stack 20.

It is to be understood that other interfolding configurations than the interfacing configuration shown in FIG. 4 is conceivable for the stacks as disclosed herein. The number of folds in the wipes may be varied depending on the size of wipes and/or on the size and shape of the package dispenser. In a package dispenser containing more than one stack of interfolded wipes, the wipes in the different stacks may be arranged with different interfolding configurations in the different stacks, e.g. if the size of the wipes differs between the stacks. As used herein, the size of a wipe is considered to be the unfolded, planar area of the wipe. The wipes may also differ in thickness and/or basis weight, such that even if they have the same size and are folded in the same manner, a thicker (or heavier) wipe may occupy a greater proportion of the height of the stack than a thinner (or lighter) wipe. For these and other reasons, the number of wipes may be different between different stacks in the same package dispenser.

When placed in the package dispenser 10 as shown in FIGS. 1 and 3, the stacks 20 shown in FIG. 2 will be arranged with one stack beneath each of the dispensing openings 60', 60" i.e., with one stack on each side of the handle 40 in the package dispenser 10. The interfolded wipes 21 can then be dispensed through the corresponding dispensing opening 60', 60" in the package dispenser 10, as illustrated in FIG. 3 which shows wipes 21 partially withdrawn from both dispensing openings 60', 60".

Figure 5:
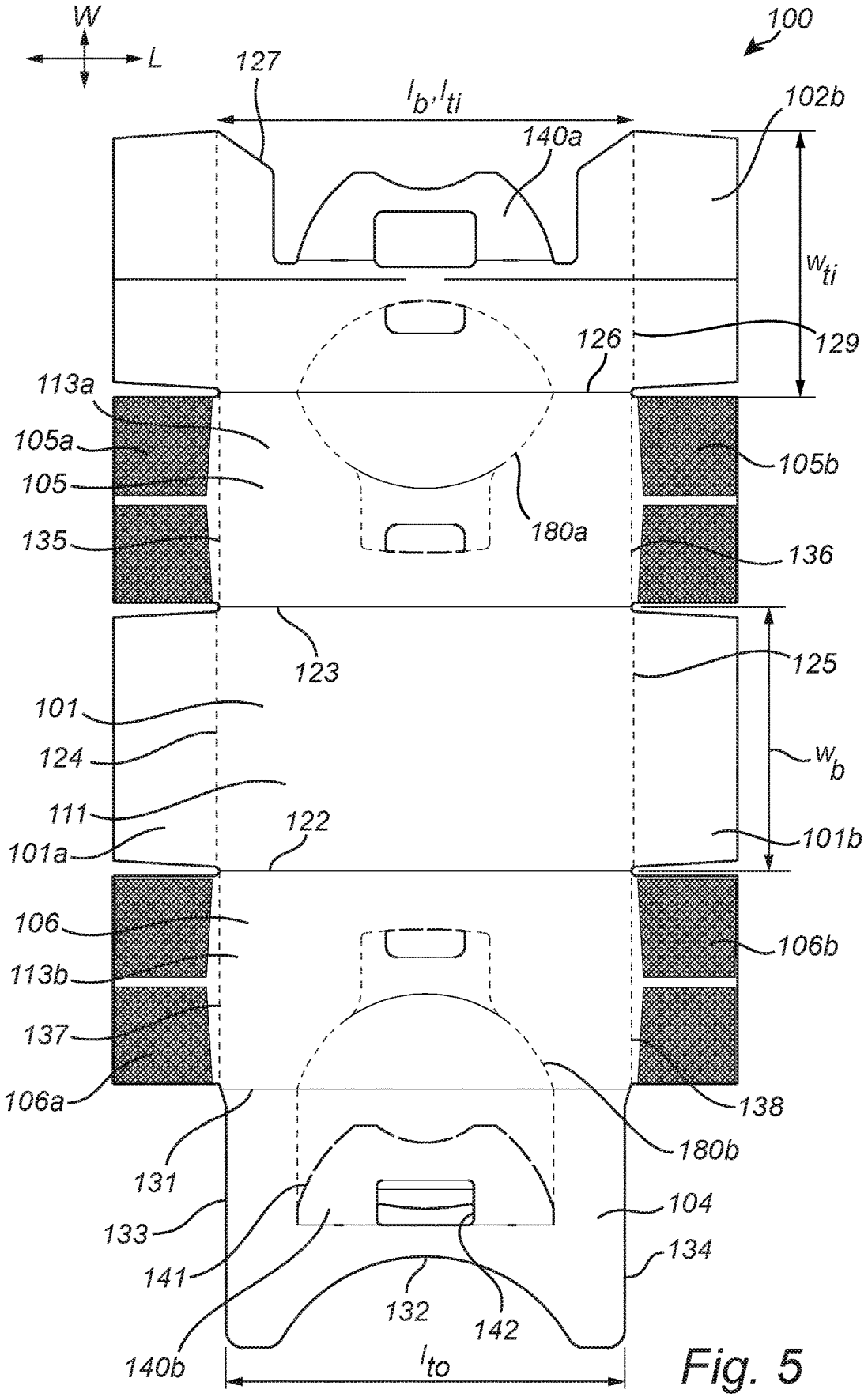
FIG. 5 shows a package blank for producing a package dispenser as disclosed herein.

With reference now to FIG. 5, there is shown a package blank 100 which may be used for making a package dispenser as disclosed herein, such as a package dispenser as shown in FIGS. 1 and 3.

The package blank 100 comprises a bottom panel 101, which is composed of a bottom wall portion 111 and a first and a second bottom panel end wall portion 101*a*, 101*b*. The bottom wall portion 111 has a first and a second side edge 122, 123. The side edges extend in a length direction L which corresponds to the length direction of a package dispenser assembled from the package blank 100. The bottom wall portion 111 further has a first and a second end edge, 124, 125 extending in a width direction W, which corresponds to the width direction of a package dispenser assembled from the package blank 100. The bottom wall portion 111 of the package blank 100 has a length $l_b$ in the length direction L and a width $w_b$ in the width direction W. The first bottom panel end wall portion 101*a* extends in the length direction L from the first end edge of the bottom wall portion 111 and a second bottom panel end wall portion 101*b* extends from the second end edge 125 of the bottom wall portion 111.

The package blank 100 comprises an inner top panel 102 comprising an inner top wall portion 112'. The inner top wall portion 112' has a first end edge 128, and a second end edge 129, the end edges extending in the width direction W. A first side edge 126 and a second side edge 127 of the inner top wall portion 112' extend generally in the length direction L between the first end edge 128, and the second end edge 129. As is seen in FIG. 5, the first side edge 126 extends along a straight line, perpendicular to the end edges 128, 129 of the inner top wall portion 112' while the second side edge 127 is a shaped edge having portions extending also in the width direction W. A handle panel 140*a* extends in the width direction W from a central portion of the second side edge 127. The inner top wall portion 112' has a length $l_{ti}$ which is equal to the length $l_b$ of the bottom wall portion 111 of the bottom panel 101 and a width $w_{ti}$; which is slightly less than the width of the bottom wall portion 111 of the bottom panel 101. The top panel further comprises a first top panel end wall portion 102*a* which extends in the length direction L from the first end edge 128 of the inner top wall portion 112' and a second top panel end wall portion 102*b* which extends in the length direction L from the second end edge 129 of the inner top wall portion 112'.

The package blank 100 comprises an outer top panel 104, the outer top panel 104 having a first end edge 133 and a second end edge 134 extending in the width direction W and a first side edge 131 and a second side edge 132 extending generally in the length direction between the first and second end edges 134 of the outer top panel 104. The length $It_o$ of the outer top panel 104 is shown to be somewhat less than the length $l_b$ of the bottom wall portion 111 of the bottom panel 101 and the length $l_{ti}$ of the inner top wall portion 112' of the inner top panel 102. As is seen in FIG. 5, the first side edge 131 of the outer top panel 104 extends along a straight line, perpendicular to the end edges 133, 134 of the outer top panel 104, while the second side edge 132 is a free edge having a shaped contour. A handle portion 140*b* is arranged in the outer top panel 104 and comprises provisions 141, 142 for partly separating the material within the handle portion 140*b* from the remaining material in the outer top panel. The provisions 141, 142 shown in FIG. 5 are pre-arranged frangible separation lines. The handle portion 140*b* of the outer top panel 104 and the handle panel 140*a* which is arranged at the second side edge 127 of the inner top panel 102 together form a handle on a package dispenser assembled from the package blank 100.

The package blank 100 further comprises a first side panel 105, the first side panel 105 comprising a first side wall portion 113*a*, the first side wall portion 113*a* of the first side panel 105 having a first side edge 123 which is identical with the second side edge 123 of the bottom wall portion 111 of the bottom panel 101 and a second side edge 126 which is identical with the first side edge 126 of the inner top wall portion 112' of the top panel 102. The first and the second side edges 123, 126 of the first side wall portion 113*a* extend in the length direction L. First and second end edges 135, 136 of the first side wall portion 113*a* extend between the first and the second side edges 123, 126 of the first side wall portion 113*a*. In a package dispenser assembled from the package blank 100, the first and second end edges 135, 136 of the first side wall portion 113*a* will be arranged in the height direction of the package dispenser. A first side panel end wall portion 105*a* extends in the length direction L from the first end edge 135 of the first side wall portion 113*a* of the first side panel 105 and a second side panel end wall portion 105*b* extends from the second end edge 136 of the first side wall portion 113*a* of the first side panel 105.

The package blank 100 also comprises a second side panel 106, the second side panel comprising a second side wall portion 113*b*, the second side wall portion 113*b* of the second side panel 106 having a first side edge 122 which is identical with the first side edge 122 of the bottom wall portion 111 of the bottom panel 101 and a second side edge 131, which is identical with the first side edge 131 of the outer top panel 104. The first and the second side edges 122, 131 of the second side wall portion 113*b* extend in the length direction L. First and second end edges 137, 138 of the second side wall portion 113*b* extend between the first and the second side edges 122, 131 of the second side wall portion 113*b*. In a package dispenser assembled from the package blank 100, the first and second end edges 137, 138 of the second side wall portion 113*b* will be arranged in the height direction of the package dispenser.

A first side panel end wall portion 106*a* of the second side panel extends in the length direction L from the first end edge 137 of the second side wall portion 113*b* of the second side panel 106 and a second side panel end wall portion 106*b* extends from the second end edge 138 of the second side wall portion 113*b* of the second side panel 106.

First provisions 180*a* for creating at a first dispensing opening are arranged as a line of weakness (i.e., a frangible line) extending in the inner top wall portion 112' and in the first side wall portion 113*a* of the first side panel 105.

Second provisions 180*b* for creating a second dispensing opening are arranged as a weakened line (i.e., a frangible line) extending in the outer top wall portion 112" and in the second side wall portion 113*b* of the second side panel 106.

One or more and—in some embodiments—all dividing lines between the different panels and panel portions, of the package blank 100 may be formed as fold lines which are arranged to facilitate folding of the package blank 100 to assume a package dispenser configuration and to promote correct folding of the package blank 100 along the dividing lines. Such fold lines may be created by partial scoring through the thickness of the packaging material, by local compression of the package material, for example.

The package blank 100 as shown in FIG. 5 can be formed into a package dispenser 10 containing two stacks of interfolded wipes, as shown in FIGS. 1-3.

The method may comprise:

providing a package blank 100;

providing at least one stack 20 of interfolded wipes 21, the stack 20 having a bottom surface 22 being formed from a bottom wipe 21', a top surface 23 being formed from a top wipe 21", two side surfaces 24 and two end surfaces 25, the side surfaces 24 and the end surfaces 25 extending between the bottom surface 22 and the top surface 23;

placing the two stacks 20 of interfolded wipes 21 with each of the stacks of wipes 21 resting with the bottom surface 22 on the bottom wall portion 111 of the bottom panel 101 of the package blank 100;

raising the first side panel 105 and the second side panel 106 in the height direction H by folding the package blank 100 along the first and second side edges 122, 123 of the bottom wall portion 111 of the bottom panel 101;

folding in the first and second side panel end wall portions 105*a*, 105*b*; 106*a*, 106*b* of the first and second side panels 105, 106 in the width direction W by folding the package blank 100 along the first and second end edges 125, 136; 137, 138 of the side wall portion 113*a*, 113*b* of each of the first and second side panels 105, 106;

raising the first bottom panel end wall portion 101*a* and the second bottom panel end wall portion 101*b* in the height direction H by folding the package blank 100 along the first and second end edges 124, 125 of the bottom wall portion 111 of the bottom panel 101;

folding in the inner top panel 102 in the width direction by folding the package blank 100 along the second side edge 126 of the side wall portion 113*a* of the first side panel 105;

folding in the outer top panel 104 in the width direction W, in over the inner top panel 102 by folding the package blank 100 along the second side edge 131 of the side wall portion 113*b* of the second side panel 106; and folding down the first end wall portion 102*a* and the second end wall portion 102*b* of the inner top panel 102 in the height direction H by folding the package blank 100 along the first and second end edges 128, 129 of the inner top wall portion 112'.

Adhesive may be applied between overlapping portions of the package blank 100 during folding of the package blank 100. Alternatively, or additionally, adhesive tape, staples, etc. may be used to keep the package dispenser 10 in the folded configuration.

When the package blank 100 has been folded as set out above, the side walls 13 in the package dispenser 10 are formed from a side wall portion 113*a*, 113*b* of a respective side panel 105, 106. The end walls 15 are formed from overlapping panel end parts 105*a*, 105*b*, 106*a*, 106*b*, 102*a*, 102*b*, 101*a*, 101*b* of the two side panels 105, 106, the inner top panel 102 and the bottom panel 101. The bottom wall 11 is formed from the bottom wall part 111 of the bottom panel 101 and the top wall 12 is formed from the inner top wall portion 112' of the inner top panel 102 and of the outer top panel 104 which overlaps the inner top wall portion 112' of the inner top panel 102.

Package dispensers containing a different number of stacks from the two stacks shown in the Figures may be assembled in a corresponding manner from an appropriately sized and shaped package blank.

The invention claimed is:

1. A package dispenser for containing and dispensing at least one stack of wipes, the package dispenser comprising:

a bottom wall;

a top wall;

two opposing side walls extending in a height direction (H) of the package dispenser and being parallel to a length direction (L) of the package dispenser; and two opposing side walls extending in the height direction (H) of the package dispenser and being parallel to a width direction (W) of the package dispenser, wherein the bottom wall, the top wall, the side walls and the end walls together delimit a storage space containing the at least one stack of wipes, wherein the top wall comprises a handle, wherein the top wall comprises provisions for creating at least one dispensing opening, wherein each of the at least one stack of wipes has a bottom surface formed from a bottom wipe, a top surface formed from a top wipe, two side surfaces and two end surfaces, wherein the side surfaces and the end surfaces extend between the bottom surface and the top surface, wherein each of the at least one stack of wipes is placed in the storage space and rest with the bottom surface on the bottom wall of the package dispenser, and with the top surface of the stack facing the top wall of the package dispenser, wherein each of the at least one stack of wipes in the package dispenser is a stack of interfolded wipes, wherein each of the at least one stack of wipes is arranged to be dispensed from the top surface of the stack, the interfolded wipes in the stack being dispensed through a corresponding one of the at least one dispensing opening, wherein the top wall comprises an inner top wall portion and an outer top wall portion that overlap with each other, wherein the inner top wall portion is part of an inner top panel having a length in the length direction of the package dispenser which is greater than a length in the length direction between the side walls of the package dispenser, the inner top panel comprising the inner top wall portion, a first top panel end wall portion and a second top panel end wall portion, each of the first top panel end wall portion and the second top panel end wall portion being folded in the height direction toward the bottom wall and forming part of a respective one of the side walls of the package dispenser, and wherein the outer top wall portion being formed from an outer top panel having a length in the length direction which is equal to or shorter than the length in the length direction between the side walls of the package dispenser, the outer top wall portion overlying and being supported by the inner top panel, the inner top wall portion of the inner top panel and the outer top wall portion together constituting the top wall of the package dispenser.

2. A package dispenser according to claim 1, wherein the at least one dispensing opening comprises a dispensing opening portion which extends into a side wall of the package, the side wall of the package dispenser comprising provisions for creating the dispensing opening portion in the side wall of the package dispenser.

3. A package dispenser according to claim 1, wherein the provisions for creating the at least one dispensing opening comprises or consists of one or more material weakenings being arranged in the package dispenser.

4. A package dispenser according to claim 1, wherein two stacks of interfolded wipes are arranged in the storage space.

5. A package dispenser according to claim 1, wherein the handle is a two-part handle, with a first handle part being arranged on the inner top wall portion and a second handle part being arranged on the outer top wall portion.

6. A package dispenser according to claim 1, wherein each of the side walls is formed from a side panel, and wherein each of the side walls is formed from overlapping panel end parts which are panel end parts of the two side panels, the inner top panel and panel end parts of a bottom panel forming the bottom wall.

7. A package dispenser according to claim 1, wherein the package dispenser is a cardboard package dispenser, such as a corrugated fibreboard package dispenser.

8. A package dispenser according to claim 1, wherein the interfolded wipes are reversed interfolded wipes.

9. A package dispenser according to claim 1, wherein the interfolded wipes each have a size in a flat, unfolded state of 42×35.5 cm or 63×35.5 cm.

10. A package dispenser according to claim 1, wherein each of the at least one stack of interfolded wipes contains 70 to 120 interfolded wipes.

11. A package dispenser according to claim 1, wherein the interfolded wipes are made from nonwoven material, such as a hydroentangled nonwoven material comprising cellulosic fibres.

12. A package blank for forming a package dispenser according to claim 1, wherein the package blank comprises:

a bottom panel comprising a bottom wall portion, the bottom wall portion having a first and a second side edge extending in the length direction (L) and a first and a second end edge extending in the width direction (W), the bottom wall portion having a length (lb) in the length direction (L) and a width (wb) in the width direction (W), a first bottom panel end wall portion extending in the length direction (L) from the first end edge of the bottom wall portion and a second bottom panel end wall portion extending from the second end edge of the bottom wall portion;

an inner top panel comprising an inner top wall portion, the inner top wall portion having a first end edge and a second end edge extending in the width direction (W) and a first side edge and a second side edge, the first side edge and the second side edge extending between the first end edge and the second end edge, the inner top wall portion (112') having a length (lti) equal to the length (lb) of the bottom wall portion of the bottom panel and a width (wti) equal to or less than the width (wb) of the bottom wall portion of the bottom panel, and having a first top panel end wall portion extending in the length direction from the first end edge of the inner top wall portion and a second top panel end wall portion extending in the length direction (L) from the second end edge (of the inner top wall portion (112');

an outer top panel, the outer top panel having a first end edge and a second end edge extending in the width direction (W) and a first side edge and a second side edge extending in the length direction (W) between the first end edge and the second end edge, a length (lto) of the outer top panel being equal to or less than the length (lb) of the bottom wall portion of the bottom panel and being equal to or less than the length (lti) of the inner top wall portion of the inner top panel;

a first side panel, the first side panel comprising a first side wall portion, the first side wall portion of the first side panel having a first and a second side edge extending in the length direction (L) and a first and a second end edge extending between the first and the second side edges of the first side wall portion, a first side panel end wall portion extending in the length direction (L) from the first end edge of the first side wall portion and a second side panel end wall portion extending from the second end edge of the first side wall portion, the first side panel being contiguous with the inner top panel along the first side edge of the inner top wall portion;

a second side panel, the second side panel comprising a second side wall portion, the second side wall portion of the second side panel having a first and a second side edge extending in the length direction (L) and a first and a second end edge extending between the first and the second side edges of the second side wall portion, a first side panel end wall portion extending in the length direction (L) from the first end edge of the second side wall portion and a second side panel end wall portion extending from the second end edge of the second side wall portion, the second side panel being contiguous with the outer top panel along the first side edge of the outer top panel; and wherein a handle is arranged in the inner top panel and/or in the outer top panel, and wherein one or both of the inner top panel and the outer top panel comprises provisions for creating at least one dispensing opening.

13. A method of forming a package dispenser containing at least one stack of interfolded wipes, the method comprising:

providing a package blank according to claim 12;

providing at least one stack of interfolded wipes, the stack having a bottom surface being formed from a bottom wipe, a top surface being formed from a top wipe, two side surfaces and two end surfaces, the side surfaces and the end surfaces extending between the bottom surface and the top surface;

placing the at least one stack of interfolded wipes with each of the at least one stack of wipes resting with the bottom surface on the bottom wall portion of the bottom panel of the package blank;

raising the first side panel and the second side panel in the height direction (H) by folding the package blank along the first and second side edges of the bottom wall portion of the bottom panel;

folding in the first and second side panel end wall portions of the first and second side panels in the width direction (W) by folding the package blank along the first and second end edges of each of the first side wall portion and the second side wall portion;

raising the first bottom panel end wall portion and the second bottom panel end wall portion in the height direction (H) by folding the package blank along the first and second end edges of the bottom wall portion of the bottom panel;

folding in the inner top panel in the width direction by folding the package blank along the second side edge of the first side wall portion of the first side panel;

folding in the outer top panel in the width direction (W) in over the inner top panel by folding the package blank along the second side edge of the second side wall portion of the second side panel; and folding down the first end wall portion and the second end wall portion of the inner top panel in the height direction (H) by folding the package blank along the first and second end edges of the inner top wall portion.

14. A method according to claim 13, wherein adhesive is applied between overlapping portions of the package blank during folding of the package blank.

* * * * *